United States Patent [19]

Webber

[11] Patent Number: 4,633,681

[45] Date of Patent: Jan. 6, 1987

[54] REFRIGERANT EXPANSION DEVICE

[76] Inventor: Robert C. Webber, 908 Holoma Dr., Vero Beach, Fla. 32963

[21] Appl. No.: 767,042

[22] Filed: Aug. 19, 1985

[51] Int. Cl.[4] ..... F25B 41/06

[52] U.S. Cl. ..... 62/511; 62/324.1; 62/324.6; 137/202; 137/513.5; 137/533.11

[58] Field of Search ..... 137/513.3, 533.11, 513.5, 137/519.5, 202; 62/504, 511, 222, 527, 528, 196.1, 324.1, 324.6

[56] References Cited

U.S. PATENT DOCUMENTS

| | | | |
|---|---|---|---|
| 3,659,433 | 5/1972 | Shaw | 62/511 |
| 3,841,349 | 10/1974 | Todd | 137/519.5 X |
| 3,877,248 | 4/1975 | Honnold, Jr. | 62/511 |
| 4,071,045 | 1/1978 | Brandt | 137/533.11 X |
| 4,341,090 | 7/1982 | Ramakrishnan | 62/324.6 X |
| 4,432,215 | 2/1984 | Yoshida | 62/324.6 |
| 4,487,215 | 12/1984 | Green | 137/202 X |
| 4,539,959 | 9/1985 | Williams | 137/513.5 X |

FOREIGN PATENT DOCUMENTS

| | | | |
|---|---|---|---|
| 2139328 | 11/1984 | United Kingdom | 137/533.11 |

*Primary Examiner*—Lloyd L. King

*Attorney, Agent, or Firm*—Macdonald J. Wiggins

[57] ABSTRACT

An expansion device for refrigeration systems replaces capillary tubes and automatic expansion valves. A housing is provided having an inlet tube for connection to the liquid line from the condenser and an outlet tube for connection to the evaporator. The outlet tube has a valve like seat in its inner end and orifice grooves formed in the seat. A steel ball is movably disposed in the housing such that liquid refrigerant during compressor operation forces the ball into the seat thereby forming an expansion orifice between the ball and the seat.

12 Claims, 7 Drawing Figures

REFRIGERANT EXPANSION DEVICE

BACKGROUND OF THE INVENTION

1. Field of the Invention

The present invention relates to expansion devices for refrigeration systems, and more particularly to a low cost, self-cleaning expansion device having a high efficiency.

2. Description of the Prior Art

In a refrigeration system, the liquid refrigerant from the condensing unit is at a relatively high pressure. This pressure must be reduced in the evaporator such that the refrigerant will evaporate at a low temperature. Thus, an expansion device must be provided between the liquid line and the input to the evaporator. There are a number of requirements for this device. The expansion device must, in effect, meter the liquid into the evaporator in an amount equal to that required to provide the desired refrigeration effect and which will prevent liquid refrigerant from entering the suction line to the compressor. In addition, it is desirable, when the compressor is off, that pressure equalize between the liquid side and the vapor side to minimize the startup load. The most efficient devices are expansion valves which may be operated from pressure or temperature or both. However, due to the complexity and cost of expansion valves, it is most common for small refrigeration systems such as room air conditioners and refrigerators to utilize a capillary tube control. This device is simply a length of small inside diameter tubing which may be from 18" to 12' long which throttles the movement of liquid refrigerant into the evaporator. The principle of operation involves the capillary tube's resistance to fluid flow. The pressure therefore drops as the liquid moves through the tube to the point where it begins to evaporate. The evaporation causes a sudden pressure and temperature drop as the refrigerant enters the evaporator. The capillary tube has the advantage of permitting equalization of pressure when the compressor is not running. Although the capillary tube is a low cost device, it requires a fine filter or filter-dryer at its inlet since any moisture or dirt which may flow into the capillary tube will cause it to become plugged. Similarly, a problem occurs if the capillary becomes plugged with ice or wax.

A more serious disadvantage of the capillary tube is the energy required to move the refrigerant through the tube. This is of course reflected into an increase of primary power.

Thus, there is a need for a simple expansion device which will have the advantages of the capillary tube of low cost, and pressure equalization but without the disadvantages of moisture, dirt and ice causing plugging, and of power loss through the tube.

SUMMARY OF THE INVENTION

My invention is, in one embodiment, a refrigerant expansion device having a pair of short cylindrical tubes disposed within a housing having the inner open ends thereof in a spaced apart, opposing relationship. One of the tubes includes a precision orifice groove through the sidewall at the inner end thereof. A small metal ball is disposed in the space between the two opposing tube ends. The tube having the groove therein is considered the output end of the device which is coupled into the evaporator. The other tube is considered the input end and is connected to the liquid line from the condenser.

Assume that the compressor is not operating. In this condition, the ball is free to move or float between the two tube inner ends. When the compressor is engaged, pressure increases at the input tube and a flow of liquid refrigerant into the tube will immediately force the floating ball into the end of the output tube blocking that tube except for the orifice groove therein. As will now be recognized, the ball in combination with the groove and the tube forms a orifice through which the liquid refrigerant is forced by the pressure in the liquid line. The pressure of the refrigerant will be greatly reduced in passing through the small orifice formed by the ball and the groove and will quickly vaporize as it flows into the evaporator. Due to the very short distance which the refrigerant must flow to accomplish the reduced pressure, the energy lost is extremely small.

It may also be noted that in my design, the orifice, which may collect oil, dirt and the like will be automatically cleaned of any foreign matter from the orifice or the ball seat by the engagement and disengagement of the ball from the orifice as the refrigeration unit cycles. Thus, the expansion device of my invention is self-cleaning.

I prefer that the outlet tube of the device be made from stainless steel and that the ball be of stainless steel. The inlet tube may be formed from copper tubing and the housing formed from a larger size copper tubing which is silver soldered to the inlet and outlet tubes.

It is therefore a principal object of my invention to provide a low cost expansion device which is self-cleaning and which causes a very small loss of energy due to refrigerant flow therethrough.

It is another object of my invention to provide an expansion device having an orifice defined by a metal ball forced against a seat having a groove therein wherein the ball seated only during operation of the compressor.

It is yet another object of my invention to provide an expansion device having a small orifice for metering the flow of refrigerant into the evaporator to thereby produce a minimum of energy drop across the orifice.

It is still another object of my invention to provide an expansion device having an orifice formed by a metal ball in a seat in which the ball moves away from the orifice during the off time of a refrigeration cycle thereby permitting equalization of pressure between the evaporator and the condenser.

It is a further object of my invention to provide a very low cost expansion valve for refrigeration systems which will be self-cleaning and will reduce the cost of operation thereof.

These and other objects and advantages of my invention will become apparent from the following detailed description of the drawings.

DETAILED DESCRIPTION OF THE PREFERRED EMBODIMENT

Figure 1:
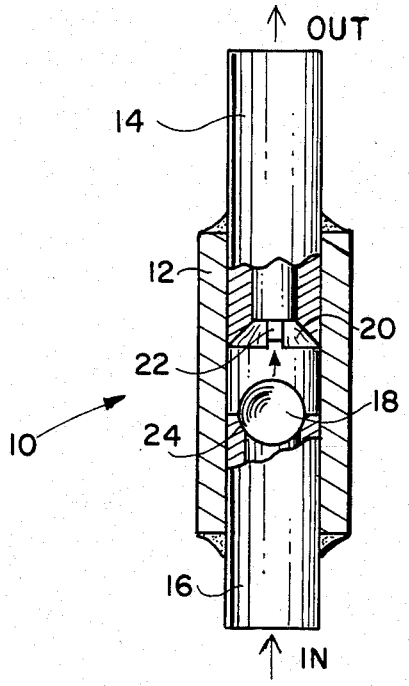
FIG. 1 is a cut away view of the expansion device of the invention.

Referring to FIG. 1, a preferred embodiment of my invention is shown. An expansion device 10 has an outer housing 12 which may be a short section of metal tubing such as copper or the like shown here in cross-sectional view. A short section of smaller diameter tubing 16 is disposed in one end of housing 12 and silver soldered or otherwise sealed thereto. Tube 16 is defined as the inlet tube and would be connected to the liquid line from the condenser when installed in a refrigeration system. A metal ball 18 is disposed in housing 12 and in FIG. 1 is shown resting on the upper end of tube 16. Ball 18 is preferably formed from stainless steel, grade 25, type 440. As will be noted, a tapered valve-type seat 24 is formed in the upper end of tube 16 in which ball 18 rests. An outlet tube 14 is disposed in the opposite end of housing 12 and is connected thereto by silver solder or other means. The outer end of tube 14 connects to the evaporator of a refrigeration system. The inner end of tube 14 includes a seat 20 formed therein having at least one notch or groove 22 cut therethrough. I prefer to use stainless steel for tube 14 and to form a precision polished seat 20 therein such that a seal may be formed between ball 18 and seat 20 as will be explained hereinbelow.

As will be understood, the expansion device 10 of FIG. 1 can be made any size desired. For example, ball 18 may be a $\frac{1}{4}''$, $\frac{3}{8}''$, or $\frac{1}{2}''$ od depending upon the size of the refrigeration system with which the invention is to be used. Tubes 12, 14, and 16 are preferably formed from standard size tubing selected in accordance with the size of the ball 18.

Figure 2:
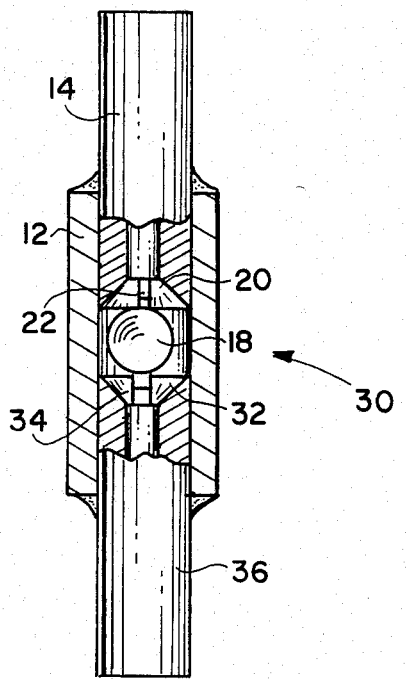
FIG. 2 is a cut away view of an alternative version of the device of FIG. 1 which is reversible and can provide a dual capacity expansion device to minimize inventory.

Assume now that expansion device 10 is connected in a refrigeration system with inlet tube 16 connected to the liquid line from the condenser and outlet tube 14 connected to the input of the evaporator. When the compressor is off, pressure will be equalized between the evaporator and the condenser since a higher pressure in the condenser can easily lift ball 18 from its seat on the inner end of tube 16. When the compressor comes on, pressure will build up in the liquid line very quickly and will cause ball 18 to be forced into seat 20. This is the condition for the operating cycle of the refrigeration system. As will be recognized, a small gap will be present between ball 18 and groove 22 thereby providing an orifice to bleed refrigerant into the evaporator via inlet tube 14. Thus, ball 14 acts as an orifice forming element. Since a large pressure drop will occur across the orifice groove 22, the liquid injected into tube 14 will flow as a mist into the evaporator and will quickly be converted to vapor in the evaporator. The size of groove 22 is selected in accordance with the size of the refrigeration system. For example, when the device is utilized with an air conditioner for home or room use, the size of the orifice would be tailored to meter the exact amount of refrigerant required by the evaporator without allowing liquid to appear in the evaporator. As is well known, there are standard BTU capacities for various models of air conditioners which increase in increments from about 5,000 BTU per hour to about 30,700 BTU per hour. Although FIG. 2 illustrates a single groove 22 in seat 20, there may be, in accordance with my invention, two or more grooves provided as required by the capacity of the refrigeration system.

Having described the construction of the expansion device of my invention, numerous advantages thereof will now be apparent. As previously discussed, ball 18 is free to move within the cavity produced between the inner ends of tubes 14 and 16 which permits ball 18 to move from its position shown in FIG. 1 to seat 20 during the refrigeration cycle and to drop back out of seat 20 when the refrigeration cycle is off. Advantageously, this produces a self-cleaning action in which dirt, oil, or other contaminants which may tend to collect will be dislodged. When ball 18 is in seat 20, thereby forming an orifice between ball 18 and groove 22, the flow of refrigerant therethrough is for only a fraction of an inch and therefore the energy loss in this short distance is minimal. Thus, the refrigeration unit using the invention will be more efficient than units with capillary tubes.

Twenty four hour running tests have been performed on an 11,500 BTU per hour room air conditioner installed in a special room of 2,264 cubic feet, the manufacturer's recommended capacity for the unit. Room temperature, condenser exhaust air temperature, suction pressure, discharge pressure, power consumption and suction line temperature were monitored and the number of starting cycles counted. Tests were run with the original capillary tube expansion device and with my expansion device.

In a typical 24 hour period, with the capillary tube device in place, the unit cycled 76 times and had a total running time of 8 hours out of 24 hours. A total of 4 kilowatt hours was consumed. With the expansion device of the invention installed, and under the same load conditions, the unit also had 76 cycles but the running time was $7\frac{1}{2}$ hours out of 24 hours. The energy consumption was $3\frac{1}{2}$ kilowatt hours. Thus, the unit using the expansion device of the invention operated about $12\frac{1}{2}$% more efficiently.

Turning now to FIG. 2, an alternative implementation of my invention is shown. Here, a first stainless steel tube 14 is attached in one end of housing 12 and a second stainless steel tube 36 is attached at the other end. Tube 36 includes a valve-type seat 32 and an orifice groove 34. Tube 14 with orifice groove 22 and housing 12 are identical to the implementation shown in FIG. 1. Groove 34 in lower tube 36 is of a different size than groove 22 in the upper tube 14. Thus, the larger orifice formed by ball 18 and groove 34 may be used with a higher capacity system than the orifice formed by ball 18 and groove 22. When the expansion device 30 is installed in a small capacity unit, tube 14 is connected to the evaporator and tube 36 is connected to the liquid line from the condenser. If the expansion device 30 is to be installed in a higher capacity refrigeration system, tube 36 is connected to the evaporator and tube 14 is connected to the liquid line from the condenser. Advantageously, this design permits a reduced inventory in a parts supply facility by providing two capacities for the single expansion device 30.

Figure 3:
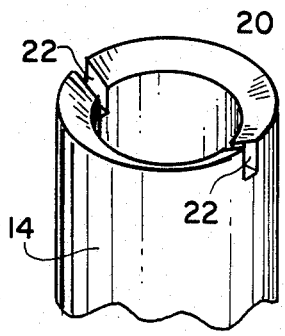
FIG. 3 is a perspective view of a typical ball seat and orifice grooves of the devices of FIGS. 1 and 2.

FIG. 3 shows a perspective view of the inner end of tube 14 as shown in FIG. 1 and FIG. 2 illustrating more clearly the ball seat 20 and orifice grooves 22. In this example, two grooves 22 are precision milled into the seat 20. The width and depth of grooves 20 are selected in accordance with the amount of refrigerant to be metered therethrough. Seat 20 may be tapered or may be cup-shaped to provide a seat for the ball.

Figure 4:
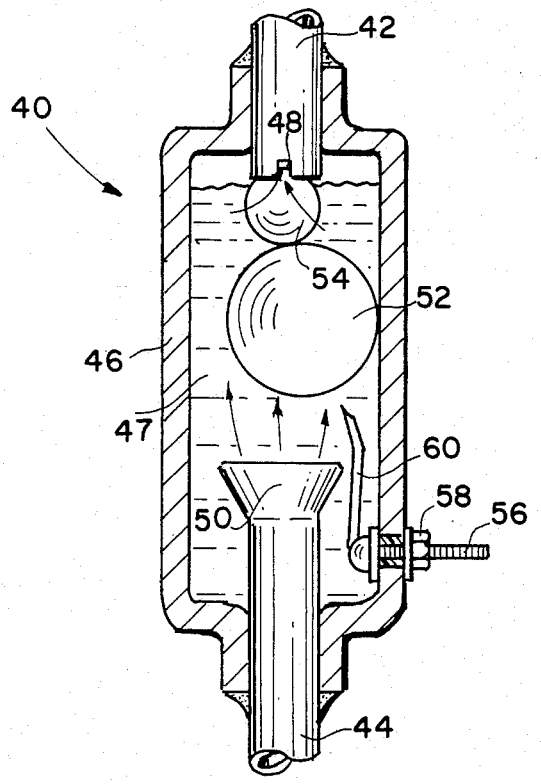
FIG. 4 is a cross-sectional view of an alternative embodiment of my invention having a floating ball, a solid ball, and an electrical contact.
Figure 5:
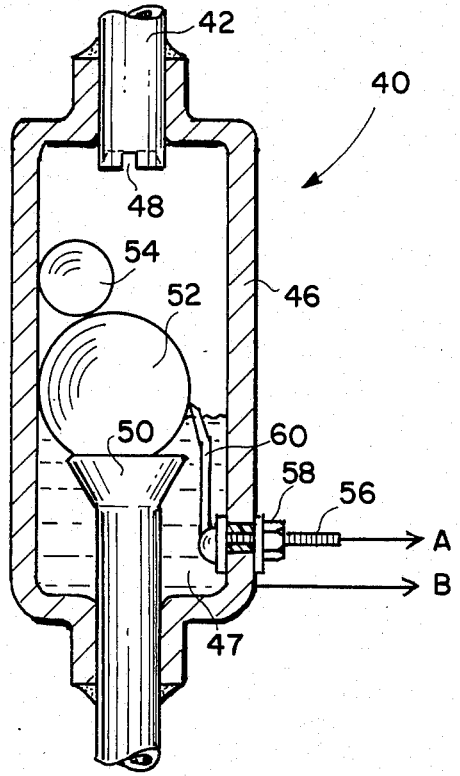
FIG. 5 is a cross-sectional view of the embodiment of FIG. 4 for a condition of low refrigerant level in which the floating ball closes the electrical contact.

In another embodiment of my invention, I include the means for monitoring the amount of liquid refrigerant in a system disclosed in my co-pending U.S. patent application, Ser. No. 650,178 filed Sept. 13, 1984. This device is used in combination with the expansion device as illustrated in FIGS. 4 and 5. An expansion device 40 in accordance with this embodiment is illustrated having an enlarged housing 46 which may be formed from copper tubing or the like and having an inlet tube 44 which is connected in a system to the liquid line from the condenser and an outlet tube 42. Outlet tube 42 connects to the evaporator and is preferably formed from stainless steel. A ball seat is formed in the inner end of tube 42 as previously described with respect to FIG. 1. Grooves 48 are formed in the ball seat of tube 42 to provide an orifice in combination with steel ball 54.

In FIG. 4, it is assumed that the compressor is in operation, filling the housing 46 with refrigerant 47 and is shown for an installation having the proper amount of refrigerant charge. The pressure of refrigerant 47 has forced ball 54 into seat 48 of tube 42 creating the desired orifice. Refrigerant will flow, as indicated by the arrows, from the condenser via tube 44 and into tube 42 via orifice groove 48. In addition to steel ball 54, a hollow ball 52 is provided which may be formed from aluminum, steel or other suitable conductive material. Due to the buoyancy of ball 52 as well as the pressure of the incoming refrigerant 47, ball 52 will move toward the upper end of housing 46 as shown. Ball 52 has no effect on the normal operation of the expansion device 40.

An electrical contact screw 56 is disposed through the sidewall of housing 46 and is sealed by nut 58 and suitable washers and sealants as will be clear to those of skill in the art. Screw 56 includes an internal contact wire 60 preferably sharpened on its upper end. When the proper amount of refrigerant 47 is present and ball 52 is floating, no contact is made therewith. In FIG. 5, it is assumed that the system has lost refrigerant 47 causing a drop in level thereof in housing 46. This permits ball 52 to drop and to contact the point of contact wire 60 as well as housing 46 and the inner end 50 of tube 44. Tube 44 and housing 46 are preferably formed from copper and the metal ball 52 therefore completes an electrical circuit between contact 60, tube 44 and housing 46. Leads A and B shown may be connected to a suitable alarm (not shown) to alert an operator that the refrigerant is low or, alternatively, to a source of refrigerant and a solenoid valve arrangement to inject additional refrigerant into the system automatically. The alarm or injection circuits would be inoperative during the compressor off cycle.

Figure 6:
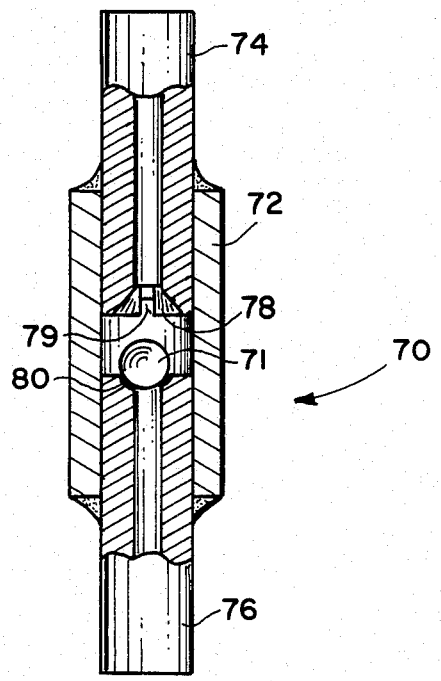
FIG. 6 is a cross-sectional view of another embodiment of my invention showing a combination of the expansion device and a check valve for use in reverse cycle refrigeration systems.

Turning now to FIG. 6, an embodiment of my invention is shown in which the expansion device is combined with a check valve. The combination expansion device and check valve 70 is constructed in an identical manner as the device of FIG. 2 previously described. Stainless steel tube 74 has a seat 78 and orifice groove 79 to thereby form with ball 71 the orifice for injection of refrigerant into the evaporator as previously discussed. The lower tube 76 is preferably formed from stainless steel and includes a polished seat 80 therein for ball 71. It is to be noted that no orifice is provided in this seat. Thus, if ball 71 is forced against seat 80 by pressure, it will form a tight seal therewith and act as a check valve.

Figure 7:
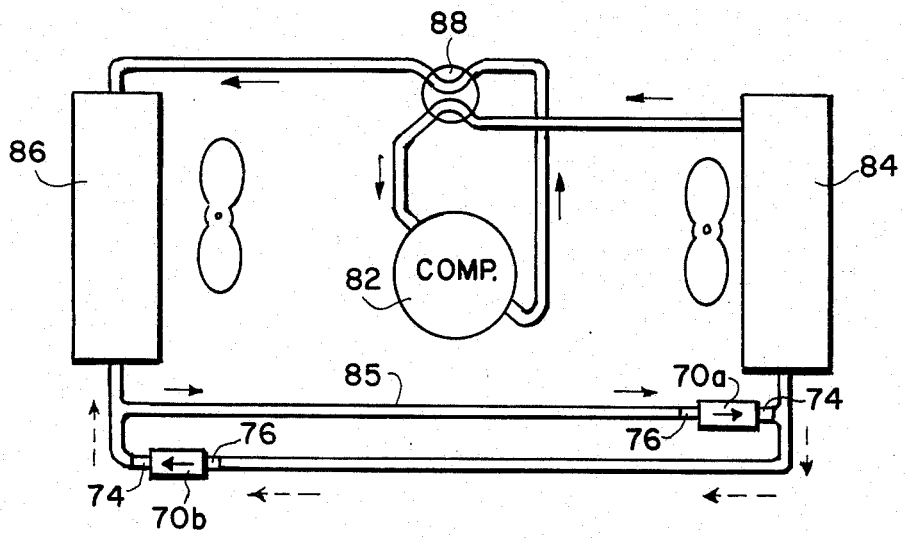
FIG. 7 is a simplified schematic diagram of a reverse cycle system having the device of FIG. 6 installed therein.

My device 70 of FIG. 6 has particular application in a reverse cycle refrigeration system as commonly used for air conditioning and heating purposes. In such systems, it is common to provide two temperature or pressure operated expansion valves, one at each heat exchanger coil such that the coil utilized as an evaporator utilizes the expansion valve connected directly thereto. This type of system requires a check valve around each expansion valve in a direction to bypass the unused expansion valve. The use of temperature or pressure operated expansion valves and the additional check valves increases the costs of such systems. With the use of my device of FIG. 6, the more expensive automatic type expansion valves can be eliminated as well as the check valves. FIG. 7 shows a simplified schematic diagram of a reverse cycle system in accordance with my invention. Here, heat exchanger coils 84 and 86 are provided which, in the position shown for reversing valve 88, compressor 82 is connected to utilize coil 86 as the condenser and coil 84 as the evaporator. In this instance, the refrigerant flow is as indicated by the arrows into coil 86 and out of coil 84. My combination expansion device and check valve 78 is installed adjacent the input to coil 84 and in this instance is operative as an expansion device with the flow of refrigerant as indicated by the solid arrows. Pressure in the line from coil 86 to combination expansion device and check valve **70*b* will be in the direction to cause it to act as a check valve and will therefore prevent the flow of refrigerant directly into evaporator 84. As will be recognized, when reversing valve 88 is rotated 90 degrees, the refrigerant from compressor 82 will flow to coil 84 as the condenser, unit 70*a* will act as a check valve, and unit 70*b* will operate, as indicated by the dashed line arrows, as an expansion device while coil 86** acts as the evaporator.

Advantageously, the use of my combination expansion device and check valve in reverse cycle systems will significantly reduce the cost of the normal expansion valve and check valve installation as well as reducing problems due to clogging and the like.

Although I have disclosed various embodiments of my invention, it is to be understood that these are for exemplary purposes only. Many variations and modifications are possible and will be obvious to those of skill in the art. Although I prefer a steel ball as the operative orifice forming element, other shapes will also serve. For example, a tear drop shape or a conical element can serve the same purpose as well as other shapes. The seats and orifice grooves may be formed in a plate or boss within the housing rather than in the inner end of a tube. Materials other than steel or copper can be substituted such as other metals and certain plastics. All of these modifications and variations are considered to fall within the spirit and scope of my invention.

I claim:

1. In a refrigeration system having a compressor, a condenser, an evaporator, and a liquid line for receiving liquid refrigerant from said condenser, an expansion device for connecting said liquid line to said evaporator comprising:

a housing having an inlet connected to said liquid line and an outlet connected to said evaporator, said outlet having a valve type seat formed therein and at least one orifice groove formed across said seat; and an orifice forming element movably disposed within said housing for seating in said seat under pressure of liquid refrigerant when said compressor is operating thereby forming an expansion orifice in concert with said orifice groove, and for unseating from said seat when said compressor is not operating thereby equalizing pressure in said refrigeration system.

2. An expansion device for a refrigeration system comprising:

a housing;

an inlet tube disposed in said housing having a first end for connection to a liquid line from a condenser in said refrigeration system and a second end within said housing;

an outlet tube disposed in said housing having a first end for connection to an evaporator in said refrigeration system and a second end within said housing and spaced apart from said second end of said inlet tube, said second end of said outlet tube having a ball seat formed therein and at least one orifice groove formed in said ball seat; and a ball disposed in said housing within the space between said second end of said inlet tube and said second end of said outlet tube, said ball adapted to seat in said ball seat during operation of said refrigeration system thereby providing a refrigerant expansion orifice between said ball and said orifice groove.

3. The device as recited in claim 2 in which said outlet tube is formed from stainless steel.

4. The device as recited in claim 2 in which said ball is formed from stainless steel.

5. The device as recited in claim 3 in which:

said housing is formed from copper tubing;

said inlet tube is formed from copper tubing; and said housing is welded to said inlet tube and said outlet tube.

6. A dual capacity expansion device for installation in a refrigeration system having a condenser and an evaporator comprising:

a housing;

a first tube having an end thereof disposed in said housing and having a first valve type seat formed in said end of said first tube, said seat having at least one first orifice groove formed therethrough;

a second tube having an end thereof disposed in said housing and a second valve type seat formed in said end of said second tube, said second seat having at least one second orifice groove formed therethrough; and a valve type element disposed within said housing between said end of said first tube and said end of said second tube and movable to seat in said first seat for forming a first expansion orifice and to seat in said second seat for forming a second expansion orifice.

7. In a refrigeration system having a compressor, a condenser, an evaporator and a liquid line for receiving liquid refrigerant from said condenser, a combination expansion device for connecting said liquid line to said evaporator and low refrigerant alarm device, comprising:

a metal housing;

an inlet tube disposed in said housing having a first end for connection to the liquid line from the condenser in said refrigeration system and a second end disposed within said housing;

an outlet tube disposed in said housing having a first end for connection to the evaporator in said refrigeration system and a second end disposed within said housing and spaced apart from said second end of said inlet tube, said second end of said outlet tube having a ball seat formed therein and at least one orifice groove formed in said ball seat;

an electrical contact disposed within said housing adjacent to said second end of said inlet tube, said contact having an electrical connection external to said housing;

a hollow metal ball movably disposed in said housing adjacent said second end of said inlet tube;

a solid metal ball movably disposed in said housing between said hollow ball and said second end of said outlet tube; and said solid ball is adapted to seat in said ball seat during operation of said compressor and said hollow ball is adapted to float in liquid refrigerant in said housing without contacting said electrical contact when said refrigeration system contains a correct charge of refrigerant and to close an electrical connection between said electrical contact and said housing when said liquid refrigerant in said housing drops due to insufficient charge of refrigerant in said system for energizing an external alarm.

8. The system as recited in claim 7 in which said housing is formed from copper.

9. The system as recited in claim 7 in which:

said hollow ball is formed from aluminum;

said solid ball is formed from stainless steel; and said outlet tube is formed from stainless steel.

10. A combination expansion device and check valve for use in a reverse cycle refrigeration system comprising:

a housing;

an inlet tube having an end thereof disposed within said housing, said end having a ball seat formed therein;

an outlet tube having an end thereof disposed within said housing, said end having a ball seat formed therein and at least one orifice groove formed through said seat; and a ball movably disposed between said inlet tube end and said outlet tube end, said ball adapted to seat in said outlet tube ball seat when liquid refrigerant under pressure is present at said inlet tube thereby forming a refrigerant expansion orifice in concert with said orifice groove, and to seat in said inlet tube ball seat when liquid refrigerant under pressure is present at said outlet tube thereby preventing flow of such liquid refrigerant.

11. The device as recited in claim 10 in which said inlet and outlet tubes are each formed from stainless steel.

12. The device as recited in claim 11 in which said ball is formed from stainless steel.

* * * * *